US005181634A

United States Patent [19]

Gibilisco

[11] Patent Number: 5,181,634

[45] Date of Patent: Jan. 26, 1993

[54] RECESSED TIP FLUID DISPENSER

[75] Inventor: Kenneth J. Gibilisco, Coopersburg, Pa.

[73] Assignee: Merck & Co., Inc., Rahway, N.J.

[21] Appl. No.: 761,522

[22] Filed: Sep. 18, 1991

[51] Int. Cl.[5] ..... B65D 37/00; B67D 3/00

[52] U.S. Cl. ..... 222/212; 222/507; 222/525; 222/562; 604/295

[58] Field of Search ..... 222/182, 209, 212, 420–422, 222/519–521, 522, 525, 548, 549, 553, 507, 562; 604/295, 302

[56] References Cited

U.S. PATENT DOCUMENTS

| | | | |
|---|---|---|---|
| 1,914,221 | 6/1933 | Stewart | 222/553 X |
| 2,173,662 | 9/1939 | Plattring et al. | 222/420 |
| 2,849,166 | 8/1958 | Eitzel | 222/519 |
| 3,029,003 | 4/1962 | Gronemeyer | 222/548 X |
| 3,618,827 | 11/1971 | Melocchi | 222/402.12 X |
| 3,945,381 | 3/1976 | Silver | 128/249 |
| 4,111,200 | 9/1978 | Sbarra et al. | 128/233 |
| 4,733,802 | 3/1988 | Sheldon | 222/181 |
| 4,834,728 | 5/1989 | McKenna | 604/301 |

OTHER PUBLICATIONS

Hording et al., ACTA Opthalmologica, 60: 213–222 (1982).

*Primary Examiner*—Andres Kashnikow
*Assistant Examiner*—Kenneth DeRosa
*Attorney, Agent, or Firm*—W. H. Nicholson; J. F. DiPrima

[57] ABSTRACT

A dispenser for liquids, e.g., ophthalmic liquids, is provided with a restricted up and down movable top that locks in both open and closed positions and that lifts to uncover an aperture and to expose a recessed dispensing tip which is always maintained below the plane of the aperture and that lowers to cover the aperture and conceal the dispensing tip.

7 Claims, 1 Drawing Sheet

RECESSED TIP FLUID DISPENSER

BACKGROUND OF THE INVENTION

A significant problem with previous devices for dispensing ophthalmic solutions is contamination of the dropper nozzle by inadvertent contact with the eye and other surfaces. The problem is described by Hovding et al., Acta Opthalmologica, 60: 213–222 (1982). This contact also can clog the orifice of the tip, making it impossible to dispense further drops. Contamination of the nozzle can then result in microbial contamination of the solution remaining in the dropper bottle and the transfer of this contamination to either or both eyes.

One common route of this contamination comprises touching the dropper nozzle to the surface of the eye during administration of medication. The contact permits contamination of the fluid remaining in the nozzle, which liquid ultimately flows back into the dropper bottle, contaminating the entire contents, and sometimes eventually plugging the dispenser tip.

Some devices have been reported which serve to prevent contact of a dropper nozzle but which were designed primarily to aid in aiming the dropper nozzle properly. See for example U.S. Pat. Nos. 4,834,728; 3,945,381; 4,111,200 and 4,733,802. These devices generally comprise a large cup-shaped or cone-shaped member, the rim of which rests on the patient's face over the eye socket and have a tip composed of a nozzle protruding through the cup-shaped member oriented so that drops from the nozzle will enter the eye.

These reported devices are fairly large, cumbersome and not easily carried in a handbag or pocket. The diameter of the cup-shaped member is large enough to permit easy contact of the dropper tip with fingers or other septic objects resulting in contamination of the device and its contents. Furthermore, covering of the eye with the large cup-shaped member may actually increase the blink reflex, thus raising the likelihood that the drop will miss the intended target.

OBJECTS OF THE INVENTION

It is an object of the present invention to provide a fluid dispensing device having a movable top that lifts to uncover an aperture and to expose a recessed dispensing tip within the aperture. A further object is to provide a fluid dispensing device having a top with restricted up and down movement that locks in both open and closed positions. Another object is to provide a fluid dispensing device wherein the dispensing tip is always maintained below the plane of the aperture. Still another object is to provide a fluid dispensing device that may be easily opened and closed by patients having limited or impaired manual dexterity. These and other objects of the present invention will be apparent from the following description.

SUMMARY OF THE INVENTION

A fluid dispensing device is provided with a movable top that lifts to uncover an aperture and to expose a recessed dispensing tip within the aperture. Reversing the movement of the top covers the aperture and conceals the dispensing tip.

Figure 3:
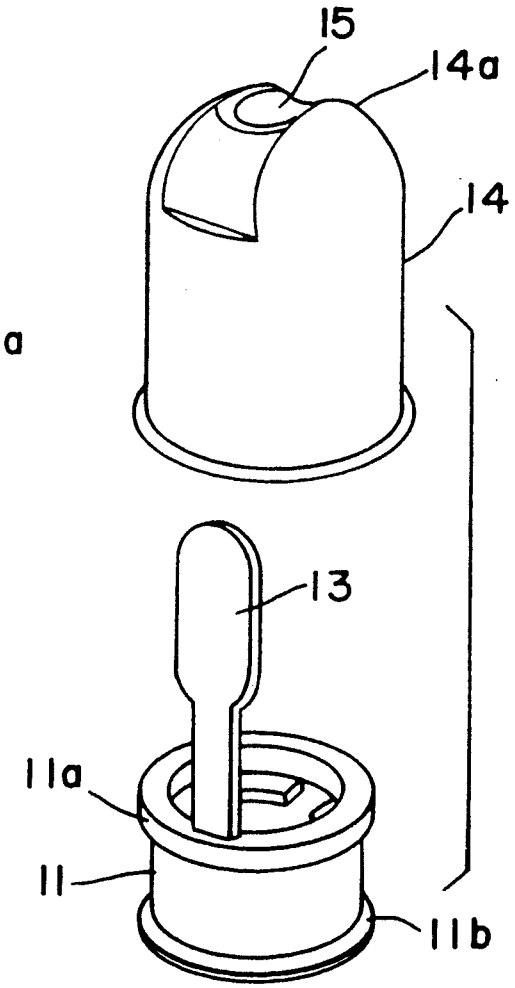
FIG. 3 is an exploded view of the cap and inner member of the dispensing device of the present invention.
Figure 2:
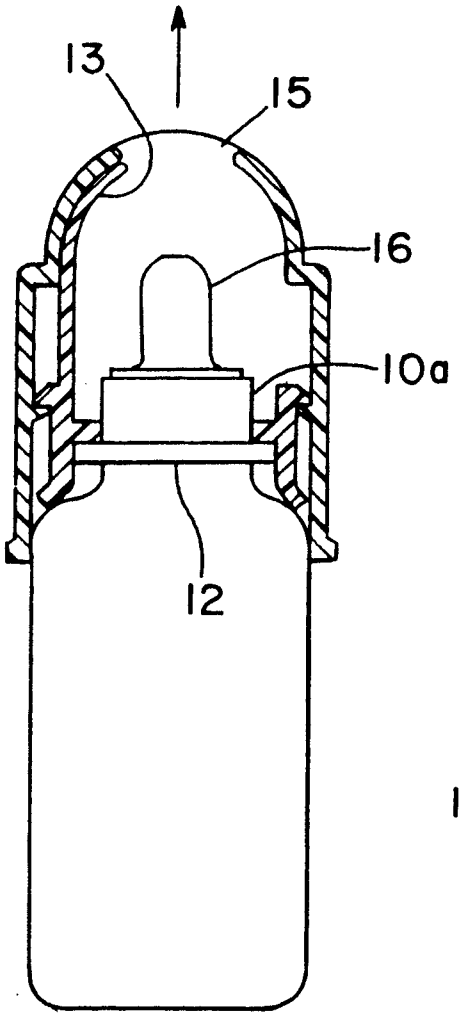
FIG. 2 is a cross-sectional view of the cap of the dispensing device of the present invention in an open position.
Figure 1:
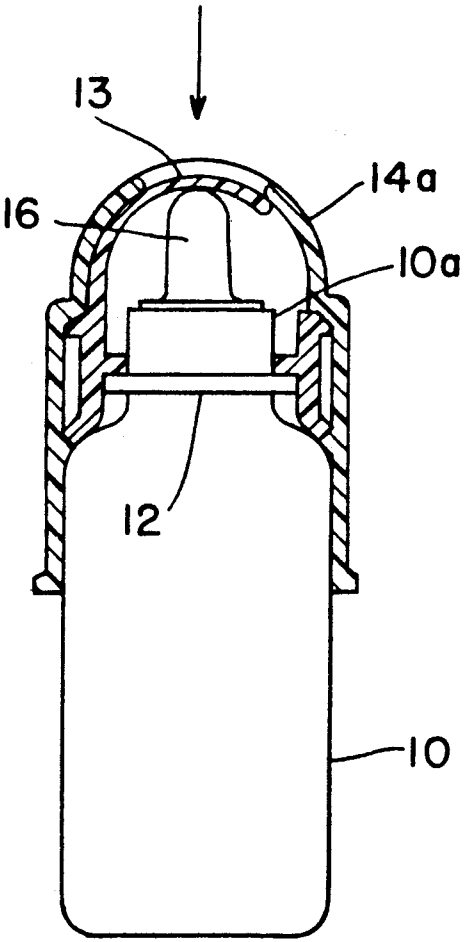
FIG. 1 is a cross-sectional view of the cap of the dispensing device of the present invention in a closed position.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should further be understood, of course, that the invention is not necessarily limited to the particular embodiments illustrated herein.

DETAILED DESCRIPTION

The fluid dispensing device of the present invention is intended for delivery of sterile fluids such as opthalmic fluids intended for administration to the eye, or sterile fluids intended for administration to any bodily surface. The fluid dispensing device of the present invention has recessed dispensing means so that fluids can be dispensed without the dispensing means contacting the surface to which the fluids are administered.

The fluid dispensing means of the present invention consists of a bottle 10 which can be formed from a variety of materials such as, for example, soft or hard plastic, e.g., polypropylene or low density polyethylene, or other manually deformable material, or glass. The bottle, if made of plastic, can be produced by conventional blow molding technique. It is to be understood that the bottle of the present invention is not limited to any specific material or to its manufacture by any specific process as it will be understood by those skilled in the art that many different materials and various manufacturing techniques can be employed.

Bottle 10 is adapted to contain a liquid medication, preferably a physiologically acceptable, liquid ophthalmic medication. The upper portion of the bottle 10 has neck 10*a* that is tapered to provide a dispenser tip 16. Tip 16 has an internal channel communicating with the bottle (not shown as obvious) and can be calibrated to deliver a predetermined amount of liquid.

Inner member 11 is a ring with upper bead 11*a* and lower bead 11*b* that is snap fitted over transfer bead 12. Inner member 11 is provided with a flexible shield member 13. A cap 14 having curved top 14*a* and aperture 15 is snap fitted over upper bead 11*a* of inner member 11 whereby it is slidably movable between upper bead 11*a* and lower bead 11*b*. As cap 14 is pushed down toward lower bead 11*b*, shield 13 contacts the curved upper surface 14*a* of cap 14 and is bent to conform to the inner surface of cap 14. As shield 13 bends it slides across curved top 14*a* to close aperture 15. In this position dispensing tip 16 is not only concealed but protected from contamination by dust, dirt or any other source of contamination. When cap 14 is lifted, shield 13 slides away from aperture 15 to expose dispensing tip 16 so that contents of the bottle can be withdrawn. At all times that tip 16 is exposed, however, it is always recessed within cap 14 and so protected from accidental contamination. Since cap 14 does not have to be removed to uncover aperture 15. it is impossible to drop or lose the overcap.

It will be understood by those skilled in the art that various modifications to the embodiment disclosed above can be made without, however, departing from the essence of the present invention. For example, instead of being snap fitted over inner member 11, cap 14 can be provided with internal threads that fit external threads on inner member 11. Other methods can be used as well. It is also with the purview of the present invention to make the dispensing device of the present invention from fewer or more components, for instance, by forming the bottle and inner member in one step as a single piece.

What is claimed is:

1. A container for storing and dispensing a liquid comprising:

a body having a neck, a transfer bead formed on said neck, a dispensing tip formed on the top of said neck and having a longitudinal axis;

an inner member being connected to said body on said transfer bead and having a flexible shield member vertically projecting from the top of said inner member; and an actuating cap for protecting said dispensing tip being connected to said inner member and having an aperture coaxially aligned with said longitudinal axis, said actuating cap being longitudinally movable along said inner member between a lower closed position wherein said flexible shield member flexes to cover said aperture and conceal said dispensing tip and an upper raised position wherein said flexible shield member slides away from said aperture to expose said dispensing tip.

2. A container according to claim 1 wherein the top of the cap is curved substantially hemispherically.

3. A container according to claim 2 wherein the flexible shield member is adapted to conform to the curvature of the cap.

4. A container according to claim 1 wherein the transfer bead is provided over the neck.

5. A container according to claim 4 wherein the inner member is provided with a attachment means to attach to the transfer bead.

6. A container according to claim 5 wherein the attachment means comprise a snap fit means.

7. A container according to claim 1 wherein the inner member is provided with means to receive and hold the cap.

* * * * *